US006684675B1

(12) United States Patent
Klingen et al.

(10) Patent No.: US 6,684,675 B1
(45) Date of Patent: Feb. 3, 2004

(54) DRAWING MACHINE

(75) Inventors: Hermann-Josef Klingen, Moers (DE); Norbert Zillekens, Hückelhoven (DE); Ralf Bonsels, Hückelhoven (DE); Thomas Winterfeldt, Rheinsberg (DE)

(73) Assignee: SMS Meer GmbH, Monchengladbach (DE)

( * ) Notice: Subject to any disclaimer, the term of this patent is extended or adjusted under 35 U.S.C. 154(b) by 0 days.

(21) Appl. No.: 10/140,839

(22) Filed: May 7, 2002

(30) Foreign Application Priority Data

May 10, 2001 (DE) ..... 101 22 655

(51) Int. Cl.[7] ..... B21C 1/14

(52) U.S. Cl. ..... 72/290; 72/287; 72/430; 72/441; 226/112; 226/162

(58) Field of Search ..... 72/274, 278, 287, 72/290, 291, 292, 430, 441; 226/108, 112, 158, 162, 4; 310/12, 16, 112

(56) References Cited

U.S. PATENT DOCUMENTS 3,881,339 A * 5/1975 Mammell ..... 72/257
3,948,070 A * 4/1976 Hentzschel et al. ..... 72/10.3
6,179,189 B1 * 1/2001 Otoshi ..... 226/32
6,194,859 B1 * 2/2001 Everman et al. ..... 318/568.2
6,262,499 B1 * 7/2001 Disbo ..... 310/12

FOREIGN PATENT DOCUMENTS

| | | | |
|---|---|---|---|
| DE | 2852071 | 6/1980 | |
| DE | 1206027 | * 11/2000 | ..... 72/252 |
| EP | 0371165 | 6/1990 | |

* cited by examiner

*Primary Examiner*—Ed Tolan
(74) *Attorney, Agent, or Firm*—Herbert Dubno; Andrew Wilford

(57) ABSTRACT

An apparatus for drawing a strand has a frame extending in a longitudinal direction, a pair of substantially identical linear motors each having a primary fixed on the frame, and a movable secondary slidable along the respective primary in the direction. The primaries extend parallel to the direction and are transversely spaced on a plane extending in the direction. A strand clamp capable of gripping the strand is fixed between the secondaries. Electricity is supplied to the primaries to longitudinally displace the secondaries and clamp in the frame so that the clamp and any strand held by it are advanced longitudinally through the frame.

11 Claims, 4 Drawing Sheets

DRAWING MACHINE

FIELD OF THE INVENTION

The present invention relates to a drawing machine for a metal strand, that is a tube or rod. More particularly this invention concerns a device for generally continuously pulling the rod.

BACKGROUND OF THE INVENTION

In order to reduce the cross-sectional size of a metallic strand, which can be a rod or tube, it is known to engage the strand and pull it continuously, usually through a die. Since the strand normally has a length equal to a multiple of the length of the drawing machine, it must be set up to grip, advance, and release the passing strand in such a manner that it moves continuously.

German 2,852,071 of K. Rehag describes a straight-line pulling system which has two clamps movable along a line on a frame. They work in a hand-to-hand manner so as to continuously advance the strand. Each of the clamps is provided with a two-arm lever which is operated by a respective double cam with both cams on the same actuating shaft.

Another system described in European 0,371,165 of G. Wuller has a rotating drum with arcuate surface ribs that produce the alternate clamp movements.

As a result of the relatively short strokes of the clamps a large portion of each stroke is devoted to getting up to speed and slowing down for reversal. In order to obtain a high average speed, it is therefore necessary to operate at a very high frequency. The mass of the clamps puts however an upper limit on how quickly they can be shuttled back and forth.

OBJECTS OF THE INVENTION

It is therefore an object of the present invention to provide an improved drawing machine for a metallic strand.

Another object is the provision of such an improved drawing machine for a metallic strand which overcomes the above-given disadvantages, that is which operates smoothly at a relatively high speed, and that is of simple and reliable construction.

SUMMARY OF THE INVENTION

An apparatus for drawing a strand has according to the invention a frame extending in a longitudinal direction, a pair of substantially identical linear motors each having a primary fixed on the frame, and a movable secondary slidable along the respective primary in the direction. The primaries extend parallel to the direction and are transversely spaced on a plane extending in the direction. A strand clamp capable of gripping the strand is fixed between the secondaries. Electricity is supplied to the primaries to longitudinally displace the secondaries and clamp in the frame so that the clamp and any strand held by it are advanced longitudinally through the frame.

Thus a pair of symmetrically arrayed linear motors are used to displace the clamp so that the forces applied to the strand are perfectly balanced to either side and there will be no tipping or canting of the clamps. Another advantage of this is that it is possible to control the speed of the clamp very accurately, moving it downstream at one speed and back upstream at another and very quickly stopping and starting it, something aided by the fat that the linear electric motors are not particularly massive and therefore have little inertia. The secondaries are simple structures, since it is only necessary to generate eddy currents in them as is known for an electric linear motor. The more complex primaries, which typically are formed with coil plates, are fixed. These linear motors are very compact so the overall apparatus can be relatively short.

Normally in accordance with the invention the secondary is about twice as long as the primary. Furthermore the primaries are provided with cooling fins. For servicing the frame has a transversely open longitudinally side. The secondaries can be fixed and the primary movable, but this requires flexible cables and hoses to supply power and coolant to the moving primaries.

In accordance with a particularly effective embodiment of the invention used for hand-to-hand advance of the strand a second pair of substantially identical linear motors longitudinally spaced downstream in the direction from the first-mentioned pair each have a primary fixed on the frame and a movable secondary slidable along the respective primary in the direction. The primaries of the second pair of motors extend parallel to the direction and are transversely spaced along a second plane extending in the direction and crossing the plane of the first motors. A second strand clamp capable of gripping the strand and separate from the first-mentioned clamp is fixed between the secondaries of the second pair of motors. The primaries of the second pair of motors also are connected to the electricity supply. Of course three or more clamps with respective motors on respective planes could also be used.

Each primary according to the invention is of U-section, is generally bisected by the respective plane, and is open inward. Furthermore, U-shaped upstream and downstream mounting plates respectively connect the first and second pairs of drive motors to the first and second clamps. The plates are open toward each other and interfit in a downstream end position of the first clamp and an upstream end position of the second clamp. In this arrangement in accordance with the invention each clamp is flanked by two of the U-shaped mounting plates open away from each other. Thus the two clamps can be brought almost into longitudinal engagement with each other since their linear-motor secondaries are transversely offset and their mounting plates interengage.

According to another feature of the invention the frame comprises a one-piece rail having a pair of downwardly projecting upper ribs provided with the upper primaries and a pair of upwardly projecting lower ribs provided with the lower primaries. The clamps are slidable along the ribs. Such a structure is extremely rigid. In it each clamp has a lower part extending transversely between and bridging the lower ribs and an upper part extending transversely between and bridging the upper ribs. The ribs are angled and extend symmetrically to a vertical center plane.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
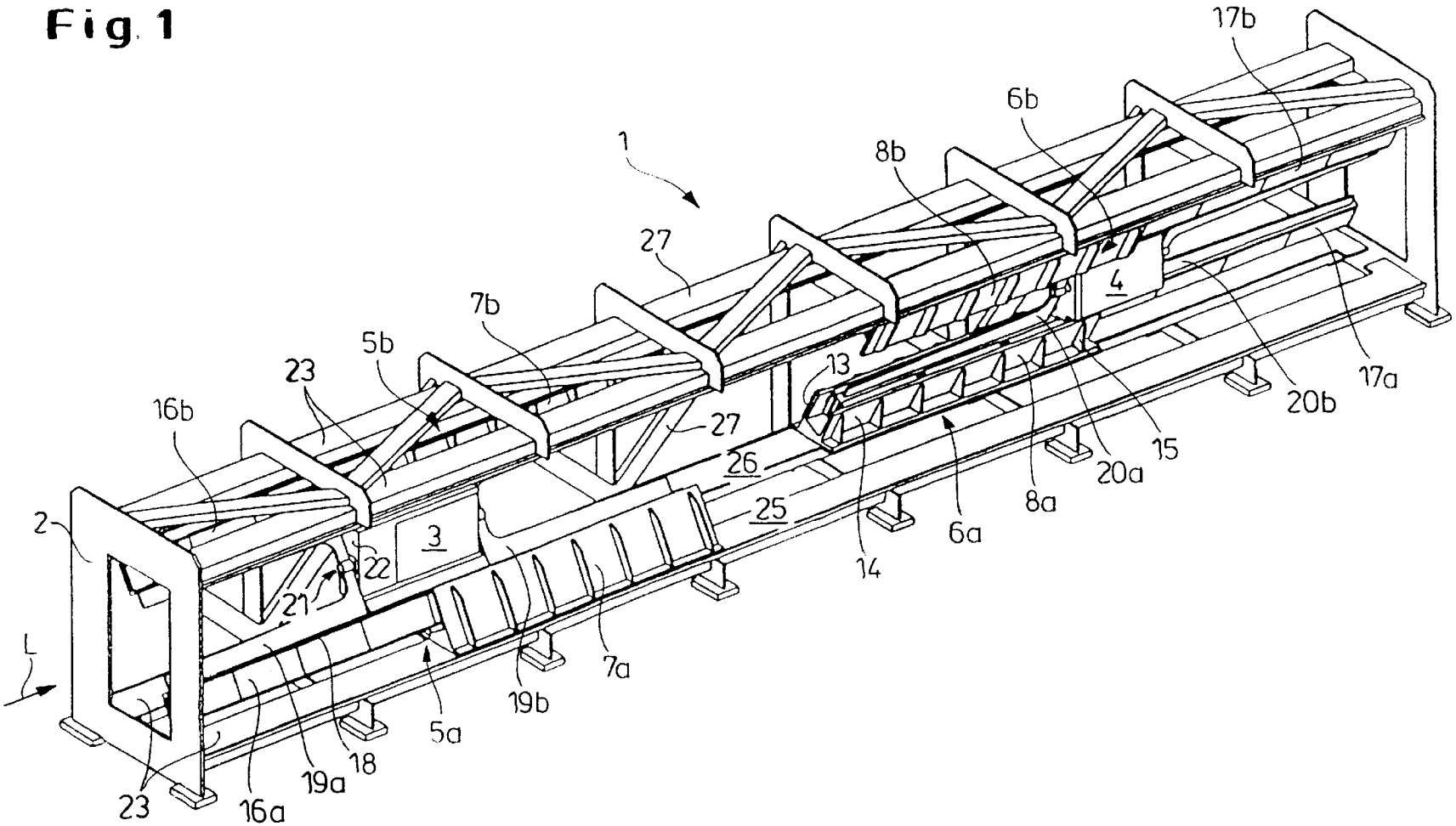
FIG. 1 is a perspective view of a drawing machine according to the invention.
Figure 2:
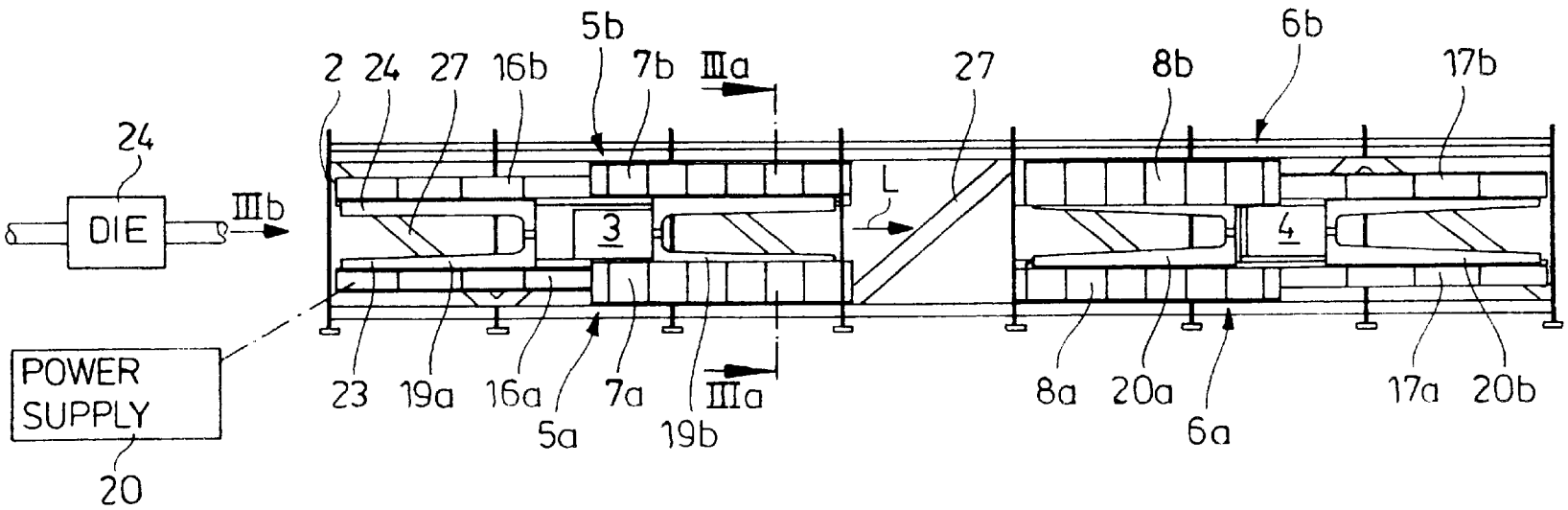
FIG. 2 is a small-scale side view of the machine.

As seen in FIG. 1, a drawing machine 1 according to the invention has a frame 2 extending in a longitudinal direction L and holding a pair of clamps 3 and 4 designed to reciprocate in this direction L in hand-to-hand fashion to continuously advance a strand S from a die 24 (FIG. 2) and through the machine 1 in the longitudinal direction L. The frame 2 carries for the clamp 3 a lower drive 5*a* and a generally identical upper drive 5*b* and for the clamp 4 similar lower upper drives 6*a* and 6*b* spaced longitudinally downstream in the direction L from the drives 5*a* and 5*b*. The frame 2 is basically formed as a parallepiped with four longitudinal beams 23 and diagonal struts 27 on three sides, leaving one side horizontally open for servicing.

Figure 3B:
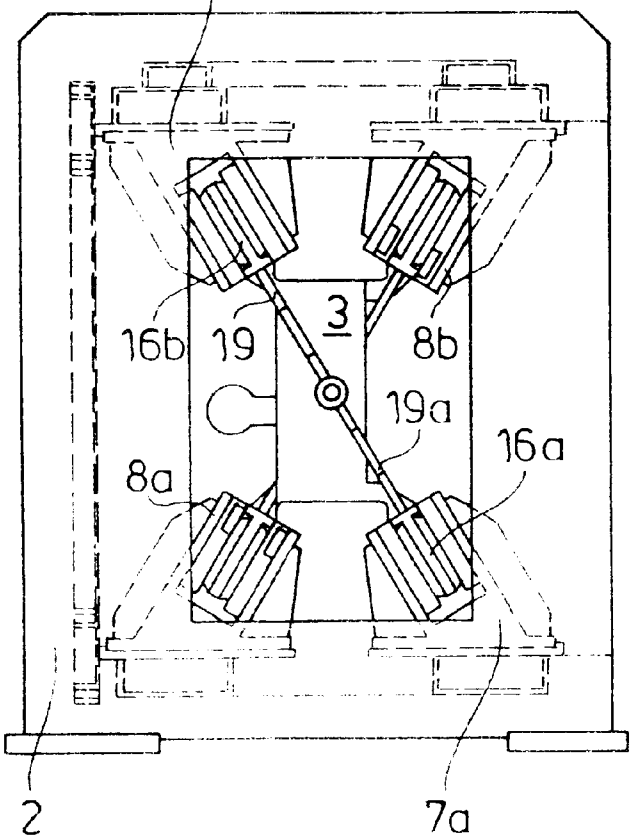
FIG. 3*b* is an end view taken in the direction of arrow IIIb of FIG. 2.
Figure 3A:
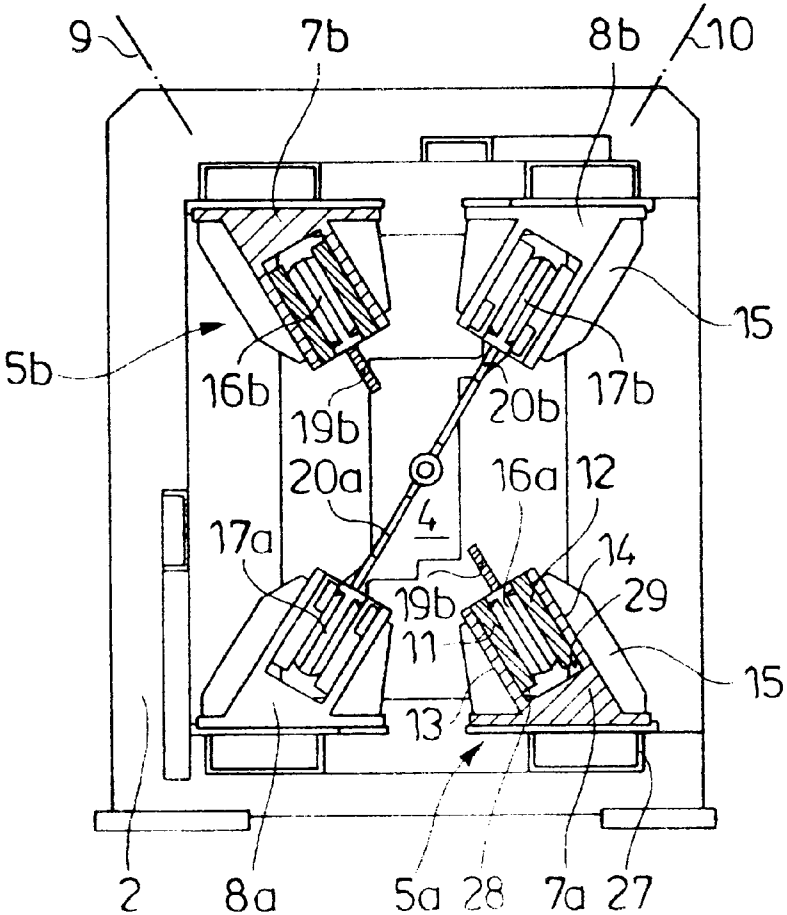
FIG. 3*a* is a section taken along line IIIa—IIIa of FIG. 2.

The lower and upper drives 5*a* and 5*b* of the clamp 3 are constituted as linear electric motors having respective lower and upper short U-section primary rails 7*a* and 7*b* fixed on the frame 2 and open toward each other along an angled plane 9 that extends in the longitudinal direction L. These rails 7*a* and 7*b* incorporate coils and have outer faces 13 and 14 (FIG. 3*a*) provided with cooling fins 15. The drives 5*a* and 5*b* also have respective movable secondaries 16*a* and 16*b* formed as long metallic plates flanked by plates 11 and 12 and slidable longitudinally in the respective U-section primary rails 7*a* and 7*b*. The plates 16*a* and 16*b* have inner edges 18 each connected to two U-shaped plates 19*a* and 19*b* having bights 21 secured to respective end faces 22 of the clamp 3. Thus the clamp 3 is longitudinally flanked by and fixed between the two plates 19*a* and 19*b* that are open longitudinally away from each other. Each plate 19*a* and 19*b* has a length equal generally to that of the respective primary rail 7*a* and 7*b* which in turn is equal to somewhat less than a quarter the overall length of the frame 2, and the secondary plates 16*a* and 16*b* are a little more than twice as long as the respective primaries 7*a* and 7*b*. This makes it possible for the drives 5*a* and 5*b* to displace the clamp 3 through a distance equal to about half the length of the frame 2 at the upstream and thereof.

The drives 6*a* and 6*b* are similarly constituted as linear electric motors having respective lower and upper short U-section primary rails 8*a* and 8*b* fixed on the frame 2 and open toward each other along an angled plane 10 that extends in the longitudinal direction L and that crosses the plane 9 on a line corresponding the center of the strand S held by the clamps 3 and 4. These rails 8*a* and 8*b* are generally identical to the rails 7*a* and 7*b*. The drives 6*a* and 6*b* also have respective movable secondaries 17*a* and 17*b* formed like the secondaries 16*a* and 16*b* and slidable longitudinally in the respective U-section primary rails 8*a* and 8*b*. The plates 17*a* and 17*b* similarly are attached to the flank the clamp 4. Each plate 17*a* and 17*b* has a length equal generally to that of the respective primary rail 8*a* and 8*b* which in turn is equal to somewhat less than a quarter the overall length of the frame 2, and the secondary plates 18*a* and 18*b* are a little more than twice as long as the respective primaries 8*a* and 8*b*. This makes it possible for the drives 6*a* and 6*b* to displace the clamp 4 through a distance equal to about half the length of the frame 2 at the downstream end thereof.

With this system it is possible for a power supply 26 connected to the coils imbedded in the plates 11 and 12 to energize these coil plates 11 and 12 such that the clamps 3 and 4 move in a hand-to-hand manner. Thus as, for instance, the upstream clamp 3 is moving downstream while it is holding the strand S, the downstream clamp 4 is moved upstream until the upstream clamp 3 is in a downstream end position and the downstream clamp 4 is in an upstream end position with the downstream mounting plate 19*b* of the upstream clamp 3 engaged with and longitudinally overlapping the upstream plate 20*a* of the downstream clamp 4. The downstream clamp 4 is reversed and moved downstream as the upstream clamp 3 comes into its downstream end position, and the clamp 3 is released from the strand S and the clamp 4 grasps it. Thereafter the downstream clamp 4 moves downstream while the upstream clamp 4 moves back upstream until they are in respective opposite end positions, whereby the upstream clamp 3 again grasps the strand S and moves downstream while the downstream clamp 4 releases the strand and moves upstream. In this manner the strand S is moved continuously.

Figure 4:
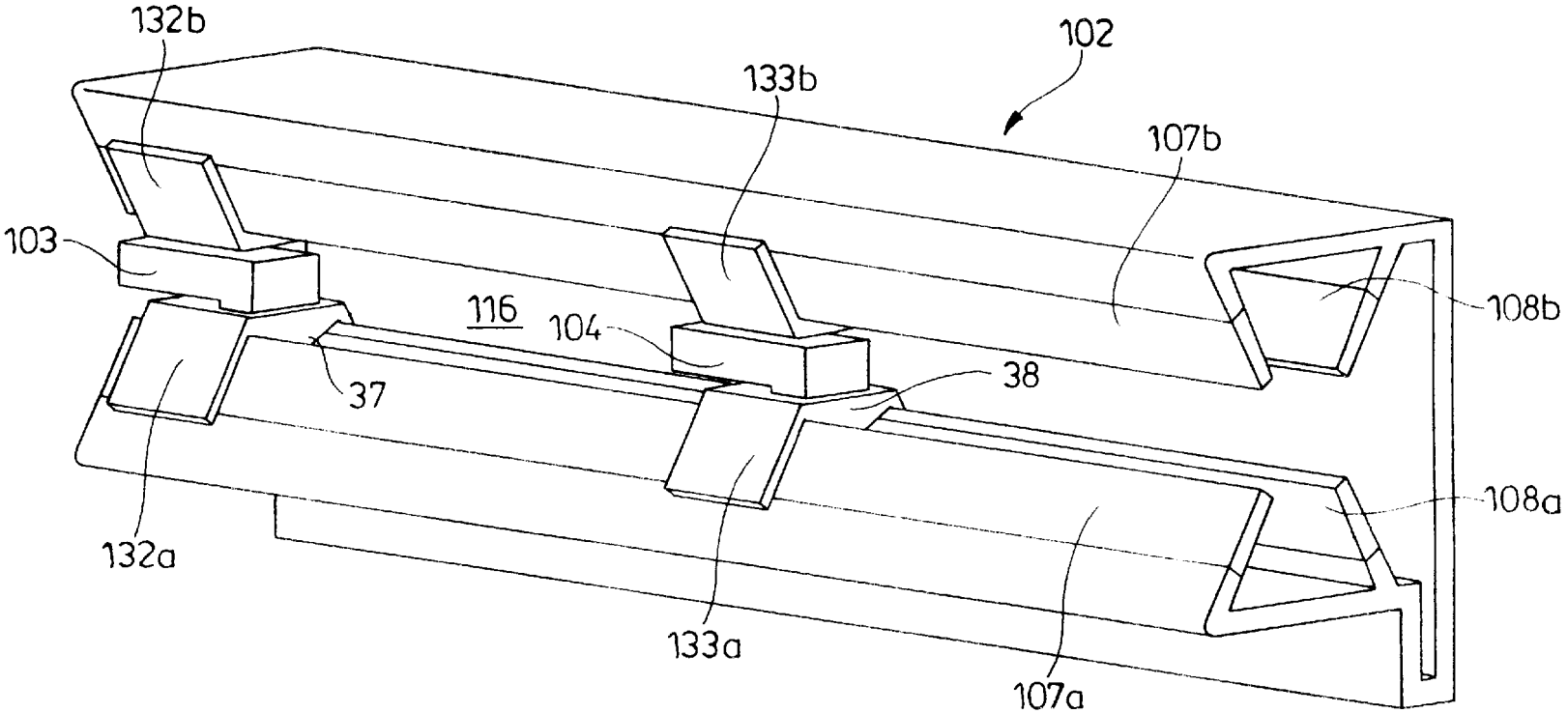
FIG. 4 is a perspective view of another drawing machine in accordance with the invention.

In the arrangement of FIG. 4 a one-piece frame 102 is unitarily formed with a pair of longitudinally extending and upwardly directed lower ribs 107*a* and 108*a* forming primaries and a pair of longitudinally extending and downwardly directed upper ribs 107*b* and 108*b* aligned with the respective ribs 107*a* and 108*a* and also forming linear-motor primaries. Clamps 103 and 104 in a space 116 between the ribs 107*a* and 108*a* on one side and 107*b* and 108*b* on the other side have downwardly extending secondary plates 132*a* and 133*a* riding on the rib 107*a* and other unillustrated but identical plates riding on the rib 108*a*. They also have upwardly extending secondary plates 132*b* and 133*b* riding on the rib 107*b* and other unillustrated but identical secondary plates riding on the rib 108*b*. These clamps further have mounting parts 37 and 38 that extend down between the lower ribs 107*a* and 108*a*.

We claim:

1. An apparatus for drawing a strand, the apparatus comprising:

a frame extending in a longitudinal direction;

a first pair of substantially identical first linear motors each having a primary fixed on the frame, and a movable secondary slidable along the respective primary in the direction, the primaries extending parallel to the direction and being transversely spaced on a first plane extending in the direction;

a first strand clamp capable of gripping the strand and fixed between the secondaries;

a second pair of substantially identical linear second motors longitudinally spaced downstream in the direction from the first pair and each having a primary fixed on the frame, and a movable secondary slidable along the respective primary in the direction, the primaries of the second motors extending parallel to the direction and being transversely spaced along a second plane extending in the direction and crossing the first plane with the primaries of the second motors offset transversely from the primaries of the first motors;

a second strand clamp capable of gripping the strand, separate from the first clamp, and fixed between the secondaries of the second motors in longitudinal alignment with the first clamp; and means for supplying electricity to the primaries of the first and second motors and thereby longitudinally, alternately, and oppositely displacing the secondaries and first and second clamps in the frame such that the clamps and any strand held by them are advanced longitudinally through the frame in hand-to-hand fashion.

2. The strand-drawing apparatus defined in claim 1 wherein each primary is of U-section, is generally bisected by the respective plane, and is open inward.

3. The strand-drawing apparatus defined in claim 1, further comprising:

U-shaped upstream and downstream mounting plates respectively connecting the first and second motors to the first and second clamps, the plates being open toward each other and interfitting in a downstream end position of the first clamp and an upstream end position of the second clamp.

4. The strand-drawing apparatus defined in claim 3, wherein each clamp is flanked by two of the U-shaped mounting plates open away from each other.

5. The strand-drawing apparatus defined in claim 1 wherein the frame comprises a one-piece rail having a pair of downwardly projecting upper ribs provided with the upper primaries and a pair of upwardly projecting lower ribs provided with the lower primaries, the clamps being slidable along the ribs.

6. The strand-drawing apparatus defined in claim 5, wherein each clamp has a lower part extending transversely between and bridging the lower ribs and an upper part extending transversely between and bridging the upper ribs.

7. The strand-drawing apparatus defined in claim 5, wherein the ribs are angled and extend symmetrically to a vertical center plane.

8. The strand-drawing apparatus defined in claim 1 wherein the secondary is about twice as long as the primary.

9. The strand-drawing apparatus defined in claim 1 wherein the primaries are provided with cooling fans.

10. The strand-drawing apparatus defined in claim 1 wherein the frame has a transversely open longitudinal side.

11. The strand-drawing apparatus defined in claim 1 wherein each of the primaries is provided with a longitudinally extending coil plate.

* * * * *